US009682461B2

(12) United States Patent
Givens

(10) Patent No.: US 9,682,461 B2
(45) Date of Patent: Jun. 20, 2017

(54) SLOPED POLISHING PAD WITH HYBRID CLOTH AND FOAM SURFACE

(71) Applicant: Showroom Polishing Systems LLC, Dayton, OH (US)

(72) Inventor: David Givens, Dayton, OH (US)

(73) Assignee: SHOWROOM POLISHING SYSTEMS LLC., Dayton, OH (US)

( * ) Notice: Subject to any disclaimer, the term of this patent is extended or adjusted under 35 U.S.C. 154(b) by 413 days.

(21) Appl. No.: 14/506,195

(22) Filed: Oct. 3, 2014

(65) Prior Publication Data

US 2016/0096254 A1 Apr. 7, 2016

(51) Int. Cl.
*B24D 13/14* (2006.01)

(52) U.S. Cl.
CPC ..... *B24D 13/142* (2013.01); *B24D 13/147* (2013.01)

(58) Field of Classification Search
CPC ..... B24D 13/142; B24D 13/147
USPC ..... 451/59, 57, 921, 461
See application file for complete search history.

(56) References Cited

U.S. PATENT DOCUMENTS 3,862,522 A 1/1975 Mednick
4,962,562 A 10/1990 Englund
5,389,032 A * 2/1995 Beardsley ..... B24D 7/14 451/359
5,944,586 A * 8/1999 Sevigny ..... B24D 7/04 451/359
6,454,633 B1 9/2002 Reinhardt et al.
6,547,643 B1 4/2003 Miller, III et al.
6,807,705 B2 10/2004 Piombini
7,404,988 B2 * 7/2008 Kuta ..... B29C 73/00 216/53
8,117,709 B2 * 2/2012 McLain ..... B24D 9/085 15/230
9,089,943 B2 * 7/2015 Lipson ..... B24D 7/18
2002/0084540 A1 7/2002 Bauer
2006/0107482 A1 5/2006 Krause
2010/0263154 A1 10/2010 Wildeman et al.
2011/0189927 A1 8/2011 Lipson
2014/0206261 A1 7/2014 Roettger et al.

OTHER PUBLICATIONS

International Search Report dated Jan. 4, 2016 pertaining to International Application No. PCT/US2015/053734, 2 pages.
Written Opinion of the International Searching Authority dated Jan. 4, 2016 pertaining to International Application No. PCT/US2015/053734, 5 pages.
International Search Report dated Dec. 22, 2015 pertaining to International Application No. PCT/US2015/053688, 2 pages.
(Continued)

*Primary Examiner* — Robert Rose
(74) *Attorney, Agent, or Firm* — Porter Wright Morris & Arthur LLP

(57) ABSTRACT

Polishing pad for use with high-speed mechanical buffers or for use by hand. More specifically, a sloped polishing pad and methods of use for the polishing pad, the sloped polishing pad having a sloped foam pad, and having a cloth, a foam, or both attached to a top surface of the foam pad, with the cloth, the foam, or both covering part of the top surface of the sloped foam pad such that gaps in the coverage allow for the sloped foam pad and either the cloth, the foam, or both to touch a polishing surface at the same time.

15 Claims, 13 Drawing Sheets

(56) References Cited

OTHER PUBLICATIONS

Written Opinion of the International Searching Authority dated Jan. 4, 2016 pertaining to International Application No. PCT/US2015/053688, 3 pages.
International Search Report and Written Opinion dated Jan. 4, 2016 pertaining to International Application No. PCT/US2015/053734.

* cited by examiner

SLOPED POLISHING PAD WITH HYBRID CLOTH AND FOAM SURFACE

FIELD

This application relates generally to polishing pads and methods of use thereof. More specifically it relates to sloped polishing pads having a sloped foam pad with a cloth or a foam or both attached to a top surface of the sloped foam pad, the cloth or the foam or both covering part of the top surface of the sloped foam pad such that gaps in the coverage provided by the cloth or the foam or both allow for the sloped foam pad and either the cloth or the foam or both to touch a polishing surface at the same time.

BACKGROUND

Restoring a surface, such as a paint surface of a car, to a state that is nearly indistinguishable from new has traditionally been a multiple step process requiring an in-depth understanding of paint types, hardnesses, and proper high-speed mechanical buffers, polishers, and polishes to complete the process.

Sand paper has been used to remove scratches from paint, but results in markings from the sand paper and leaves a lack of luster.

Polishing a surface with wool can remove some markings from the sand paper, but leaves markings from the wool that leave a surface imperfect, and can lead to damage to the paint if a user is not skilled and properly trained in use. The wool can be used with a high-speed mechanical buffers that can provide the advantage of speed, but require knowledge for use or can lead to damage to a surface, including in some cases removing a large amount of a paint base coat. There has been a long-felt need in the art for methods of polishing that do not remove the paint base coat.

There has been a long-felt need in the art for simpler, more effective ways of polishing surfaces. Embodiments described herein provide for such needs and provide surprising results.

SUMMARY

Specific embodiments herein provide for a sloped polishing pad for use with high-speed mechanical buffers or for use by hand comprising: a foam pad comprising a top surface, the foam pad comprising a first thickness and a second thickness; and at least one of a cloth and a foam that are each different in abrasiveness than the foam pad coupled to the top surface of the foam pad, the at least one of the cloth and the foam covering part of the top surface of the foam pad such that gaps in the coverage provided by the at least one of the cloth and the foam allow for the foam pad and the at least one of the cloth and the foam to touch a polishing surface at the same time.

Specific embodiments herein provide for a method of removing imperfections from a polishing surface comprising: providing a first polishing pad comprising: a foam pad comprising a top surface, the foam pad comprising a first thickness and a second thickness; and a cloth coupled to the top surface of the foam pad, the cloth covering part of the top surface of the foam pad such that gaps in coverage provided by the cloth allow for the cloth and the foam pad to touch the polishing surface at the same time; performing at a point of an imperfection at least one of: sanding the polishing surface, or applying a high-speed mechanical buffer to the polishing surface with either a polishing pad with a solid top surface of foam and cloth; and polishing the polishing surface with the first polishing pad such that cloth and the foam pad touch the first polishing surface at the same time, the polishing surface being a surface of paint from at least one of a car, a boat, or an airplane.

Specific embodiments herein provide for a method of removing imperfections from a polishing surface comprising: providing a buffer head with a sloping bottom surface and coupling the buffer head to a polishing pad, the polishing pad comprising: a foam pad; and a cloth coupled to a top surface of the foam pad, the cloth covering part of the top surface of the foam pad such that gaps in the coverage provided by the cloth allow for the cloth and the foam pad to touch the polishing surface at the same time; performing at a point of an imperfection at least one of: sanding the polishing surface, or applying a high-speed mechanical buffer to the polishing surface with either the polishing pad with a solid top surface of foam and the cloth; and polishing the polishing surface with the polishing pad such that the cloth and the foam pad touch the polishing surface at the same time, the polishing surface being a surface of paint from at least one of a car, a boat, or an airplane.

DETAILED DESCRIPTION

Figure 1:
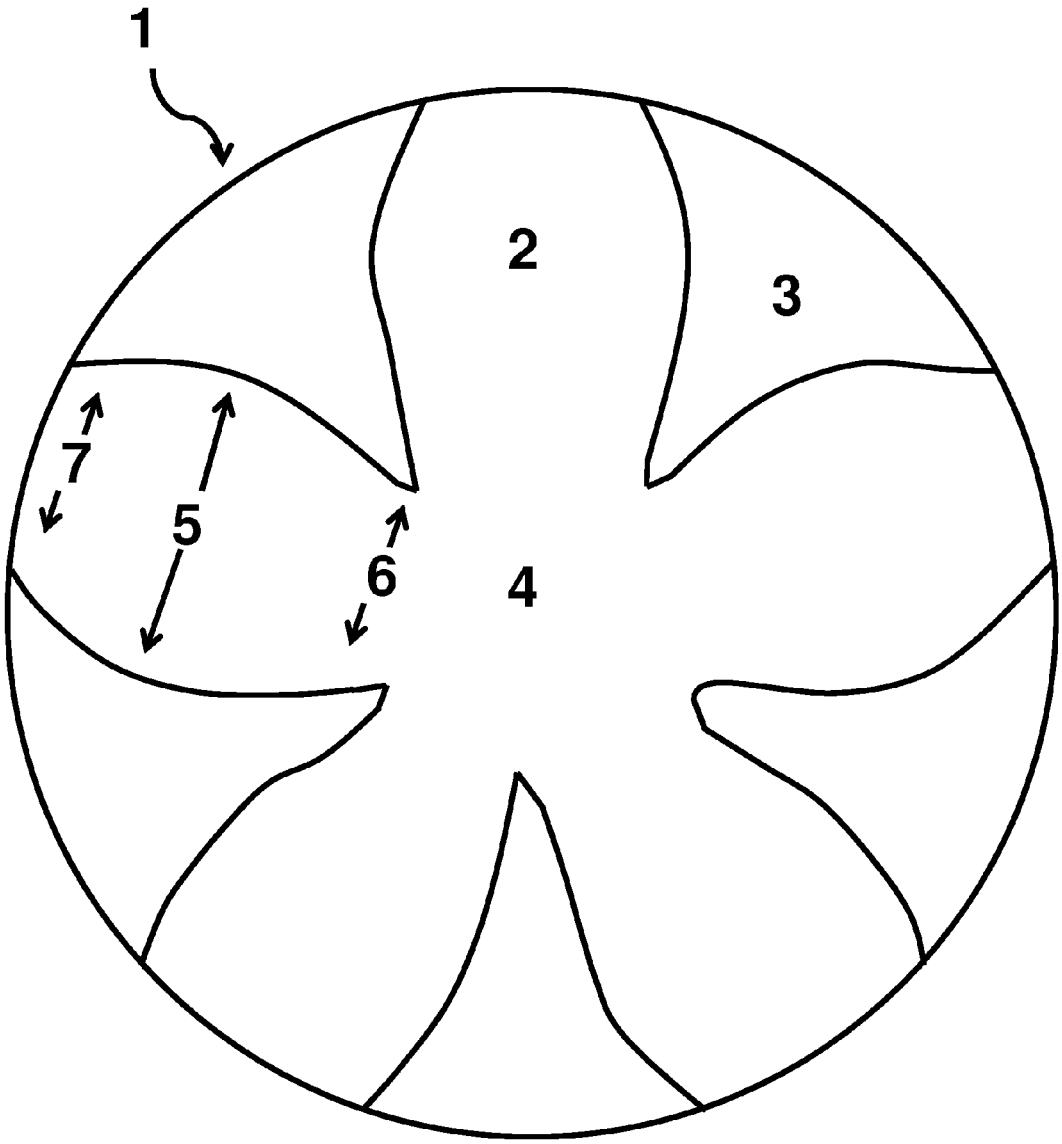
FIG. 1 illustrates an embodiment of a polishing pad as described herein demonstrating the foam pad with a cloth, and also illustrating the top surface with gaps.

Specific embodiments of the present disclosure will now be described. The invention may, however, be embodied in different forms and should not be construed as limited to the embodiments set forth herein. Rather, these embodiments are provided so that this disclosure will be thorough and complete, and will fully convey the scope of the invention to those skilled in the art.

Unless otherwise defined, all technical and scientific terms used herein have the same meaning as commonly understood by one of ordinary skill in the art to which embodiments of this invention belong. The terminology used herein is for describing particular embodiments only and is not intended to be limiting of the invention. As used in the specification and appended claims, the singular forms "a," "an," and "the" are intended to include the plural forms as well, unless the context clearly indicates otherwise.

Unless otherwise indicated, all numbers expressing quantities of ingredients, properties such as molecular weight, reaction conditions, and so forth as used in the specification and claims are to be understood as being modified in all instances by the term "about," which is intended to mean up to ±10% of an indicated value. Additionally, the disclosure of any ranges in the specification and claims are to be understood as including the range itself and also anything subsumed therein, as well as endpoints. Unless otherwise indicated, the numerical properties set forth in the specification and claims are approximations that may vary depending on the desired properties sought to be obtained in embodiments of the present invention. Notwithstanding that numerical ranges and parameters setting forth the broad scope of embodiments of the invention are approximations, the numerical values set forth in the specific examples are reported as precisely as possible. Any numerical values, however, inherently contain certain errors necessarily resulting from error found in their respective measurements.

Parts of methods described herein such as mathematical determinations, calculations, inputting of data for computations or determinations of equations or parts thereof can be performed on parts of or one or more computers or computer systems that can include one or more processors, as well as software to run or execute programs and run calculations or computations.

As described herein, embodiments can be used with one or more high-speed mechanical buffers. A "high-speed mechanical buffer" herein refers to one or more of a rotary machine/rotary buffer, direct drive tools, orbit/orbital polishers, flexible rotary, dual action polishers, cyclopolishers, and/or a machine with a single or dual head, or more than two heads, or machines with a rotating spindle assembly, or combinations thereof.

As used herein, "cloth" refers to any microfiber, cotton, microfiber, polyester, polyamide, and polypropylene, wool, hair, silk, flax, or other fiber known in the art for polishing, or combinations thereof.

As used herein, "top surface" of a polishing pad refers to the surface configured to touch a polishing surface.

As used herein, a "solid top surface" refers to a surface having about one-hundred percent coverage of a material or materials as described herein. For example, a solid top surface of the foam pad as described herein can comprise foam and cloth, the cloth and foam together having about one-hundred percent coverage of the top of the foam pad. This coverage can be any pattern known in the art.

As used herein, a "bottom surface" of the buffer head refers to the surface touching either an intermediate piece or a polishing pad.

As used herein a "top surface" of the buffer head refers to the surface touching the front section of the high-speed mechanical buffer.

FIG. 1 illustrates an embodiment of a polishing pad 1 as described herein demonstrating the foam pad 3 with a cloth 2, and also illustrating the top surface with gaps. The polishing pad 1 is shown, with a cloth 2 covering the top surface of the form pad 3, having gaps that are areas of the top surface of the foam pad 3, and a central cloth covering area 4. In specific embodiments the cloth 2 has a section extending out from the central cloth covering area 4 such that the portion near the center having a width 6 extends toward the periphery and increases in width (shown as middle width 5) and then decreases in edge width 7. In specific embodiments the extending sections of cloth are from about 1 to about 10 or from about 1 to about 5, or from about 5 to about 10, or 1, 2, 3, 4, 5, 6, 7, 8, 9, 10, or more in number. In specific embodiments there are gaps on each side of each extension of cloth. In specific embodiments the extensions of cloth have equal diameters from the center extending out to the edge of the top surface of the polishing pad, the width of each, extending cloth strip being equal. In specific embodiments the extending cloth sections take on the shape of a star. In specific embodiments there are slits in the cloth 2, or the cloth is a single piece made with holes, slits, slots, or other tears or openings such that the cloth can be used to cover the top surface of the foam pad. In specific embodiments the cloth 2 is formed by strips going straight across the top of the foam pad. A foam covering the top of the foam pad can take the configuration of any pattern and/or orientation of the cloth as described herein, or the gaps described therein.

Figure 2:
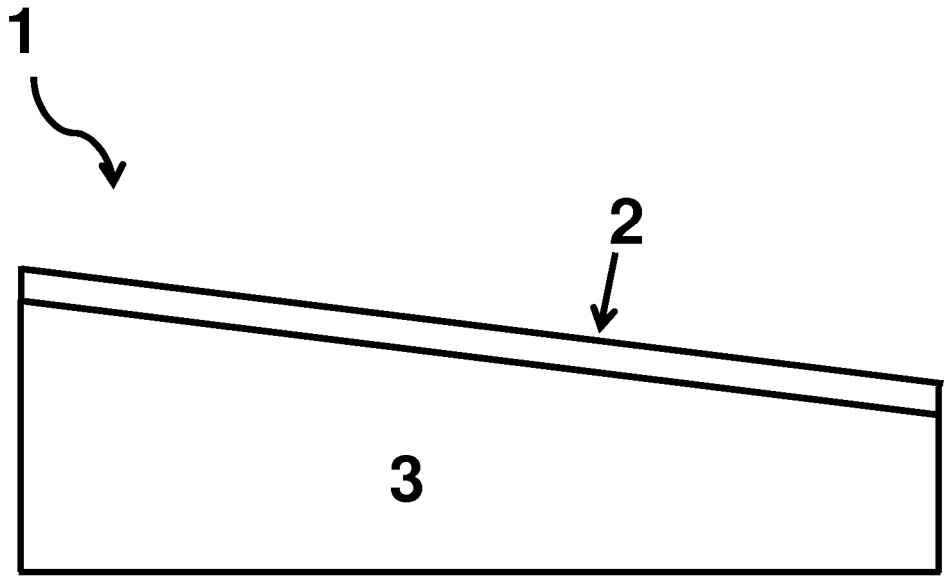
FIG. 2 illustrates a side view of the polishing pad of FIG. 1, showing the sloped polishing pad and the cloth.

FIG. 2 illustrates a side view of the polishing pad of FIG. 1, showing the sloped polishing pad 1 and the cloth 2. The foam pad 3 in specific embodiments has a continuous slope such that the first thickness at one side of the foam pad 3 comprises the thickest part of the foam pad 3, and the directly opposing second side comprises the second thickness comprising the thinnest part of the foam pad 3.

In specific embodiments the first thickness of the foam pad 3 comprises from about 2 inches to about 3 inches, and the second thickness comprises from about 0.5 inches to about 1.5 inches.

In specific embodiments a sloped foam comprises the cloth and the foam coupled to the top surface of the sloped foam pad, the polishing pad configured such that the sloped foam pad, the cloth, and the foam touch the polishing surface at the same time.

In specific embodiments the polishing pad 1 comprises cloth 2 and foam, that is different in some way (such as hardness, abrasiveness, etc) from the foam of the foam pad 3, coupled to the top surface of the foam pad 3, the cloth 2 and the different foam covering part of the top surface of the foam pad 3 such that gaps in the coverage provided by the cloth 2 and the different foam allow for the cloth 2 and/or the different foam, and the foam pad 3 to touch a polishing surface at the same time.

In specific embodiments the difference between the first thickness and the second thickness of the foam pad 3 is at least 0.5 inches.

In specific embodiments the difference between the first thickness and the second thickness of the foam pad 3 from about 0.1 inches to about 2 inches.

In specific embodiments the foam pad 3 has a top surface that is substantially circular, and the foam pad 3 top surface has a diameter of from about 2 to about 12 inches. In specific embodiments the foam pad 3 comprises a composite comprising at least two foams of different abrasivenesses from each other and from the abrasivenesses of the at least one of the cloth 2 and the foam covering part of the top surface of the foam pad 3.

Figure 3:
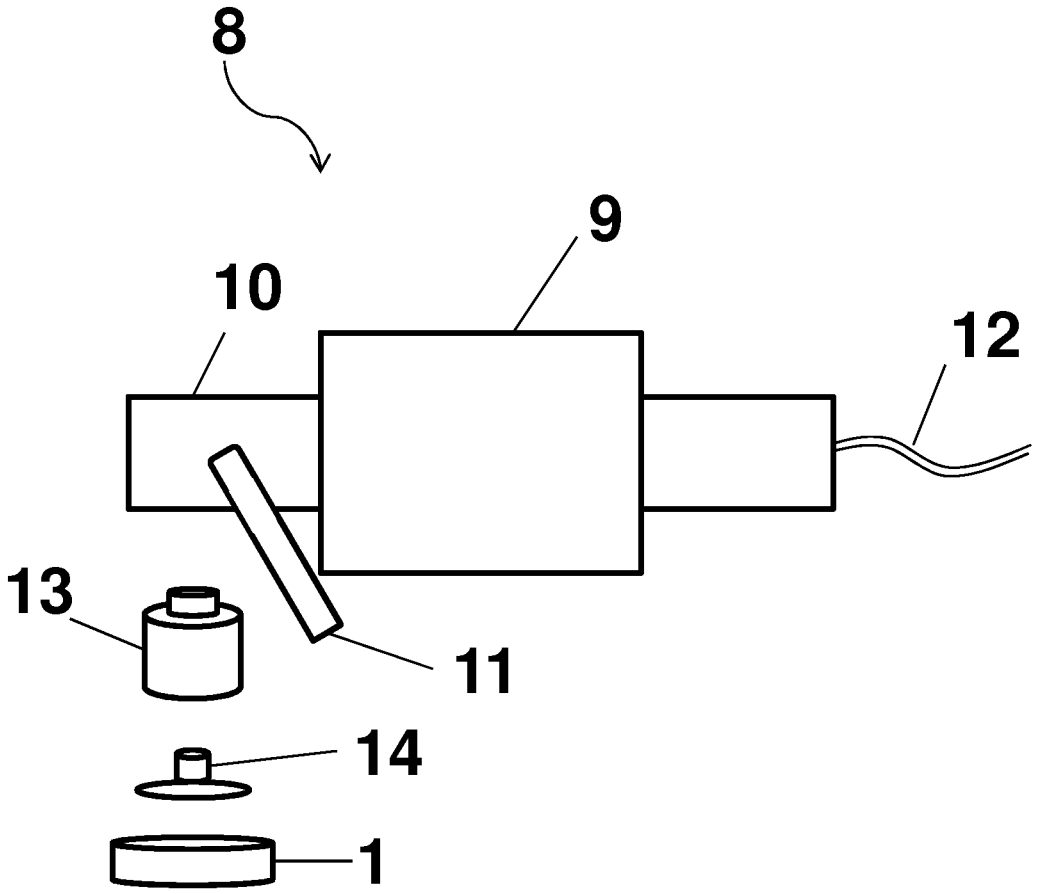
FIG. 3 illustrates an embodiment of a high-speed mechanical buffer as used with a polishing pad as described herein.

FIG. 3 illustrates an embodiment of a high-speed mechanical buffer 8 as used with a polishing pad 1 as described herein. Shown is the high-speed mechanical buffer 8 having a body 9, front section 10, handle 11, and cord 12, the front section 10 being couplable to a buffer head 13, optionally an intermediate piece 14, and a polishing pad 1.

Figure 4A:
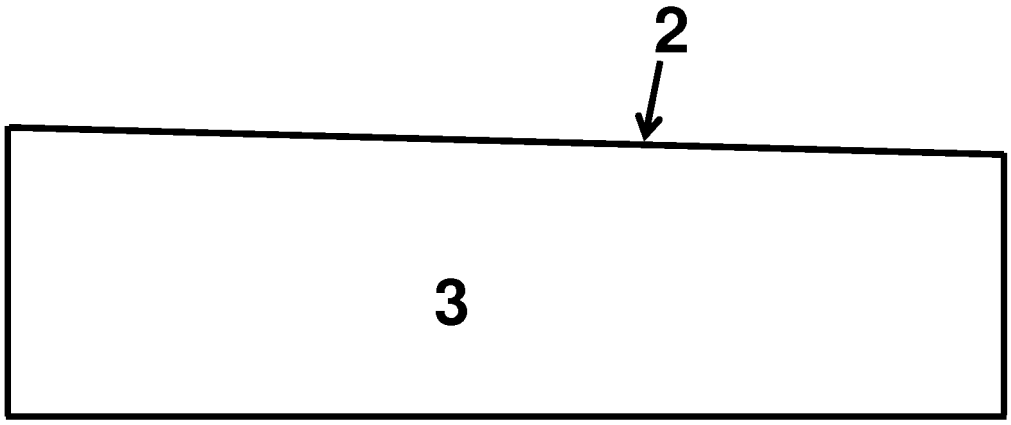
FIGS. 4A-4D illustrate side views of various additional embodiments of the polishing pad of FIG. 2.
Figure 4B:
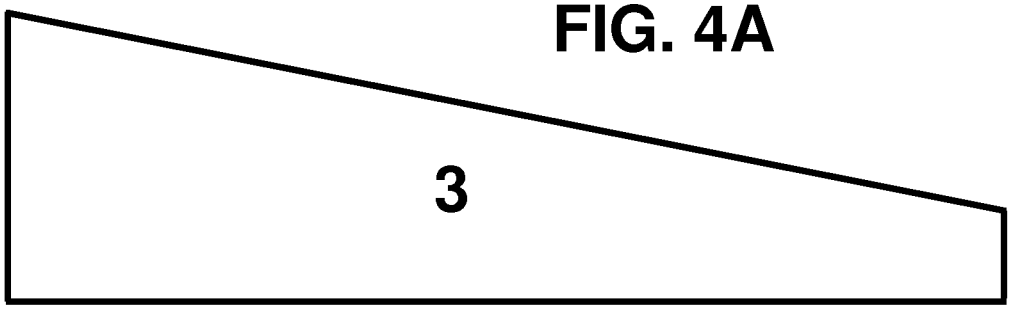
Figure 4C:
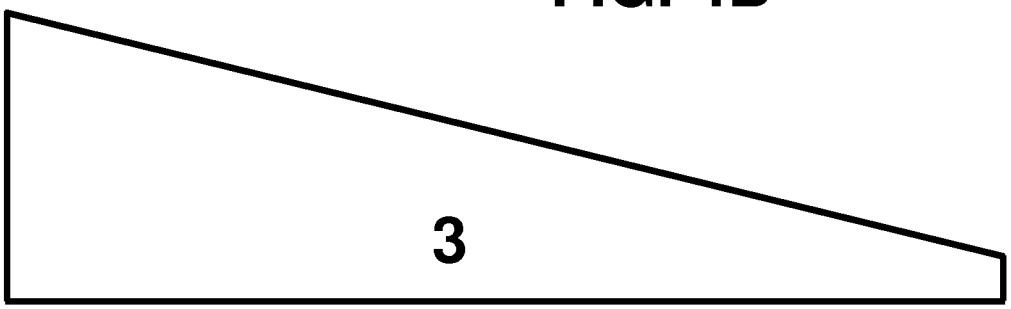
Figure 4D:
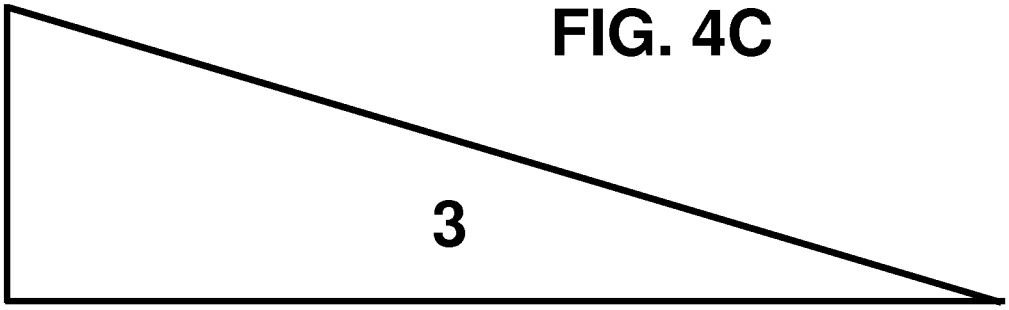

FIGS. 4A-4D illustrate side views of various additional embodiments of the polishing pad of FIG. 2. FIGS. 4A-4D illustrate foam pads 3 with a cloth 2, the polishing pad 1 sloping from one side of the foam pad to another. FIG. 4A illustrates a very slight slope change from one side of the foam pad to another side of the foam pad, with FIGS. 4B, 4C, and 4D respectively showing greater foam pad sloping. In specific embodiments each side of the foam pad 3 is from about zero to about three inches thick. In specific embodiments each side of the foam pad 3 is from about zero to about two inches thick, or from about zero to about one inch thick. In specific embodiments one side of the foam pad 3 is about zero inches thick (such as about 0.1 inches thick) and on the other side the foam pad 3 is about three inches thick.

Figure 5A:
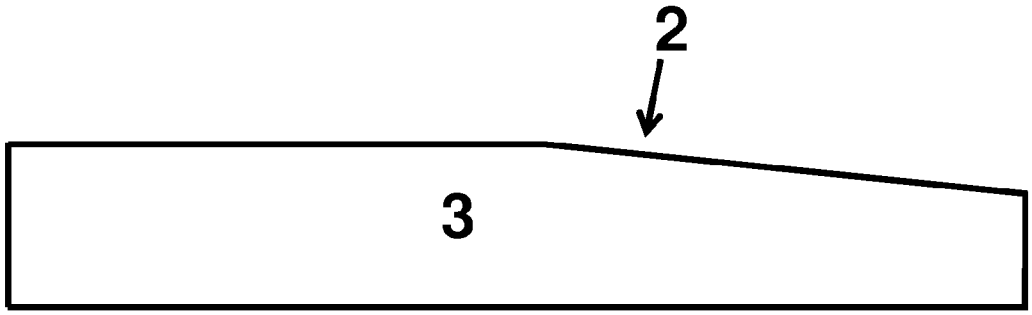
FIGS. 5A-5C illustrate side views of various additional embodiments of the polishing pad, the slope starting at a midline of the top surface of the polishing pad.
Figure 5B:
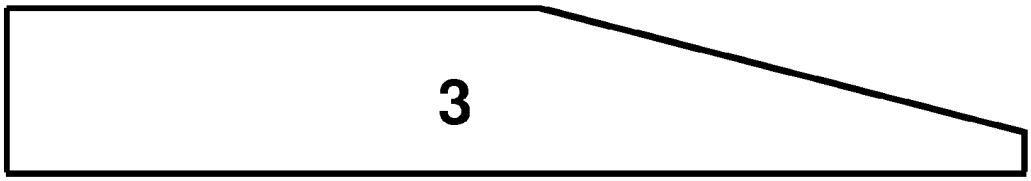
Figure 5C:
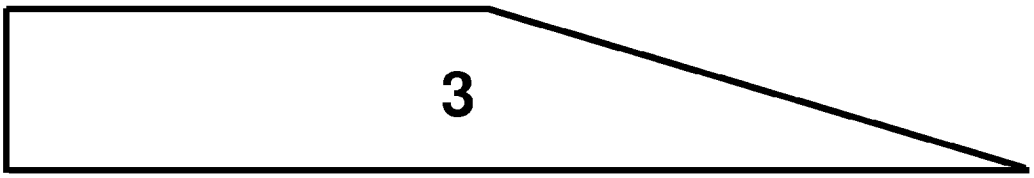

FIGS. 5A-5C illustrate side views of various additional embodiments of the polishing pad, the slope starting at a midline of the top of the polishing pad. FIGS. 5A-5C illustrate foam pads 3 with the cloth 2, the polishing pad 1 sloping from one side of the foam pad 3 to another. FIG. 5A illustrates a very slight slope change from one side of the foam pad to another side of the foam pad, with FIGS. 5C and 5D respectively showing greater foam pad sloping.

In specific embodiments about one half of the foam pad 3 has the first thickness and, starting at a midline of the top surface, the foam pad 3 has a continuous slope such that the second thickness is the thinnest thickness of the foam pad 3, and is located at the edge of the foam pad 3. FIGS. 5A-5C illustrate such embodiments.

In specific embodiments the first thickness of the foam pad 3 is from about 2 to about 3 inches, and the second thickness is from about 0.1 to about 1.5 inches.

Figure 6A:
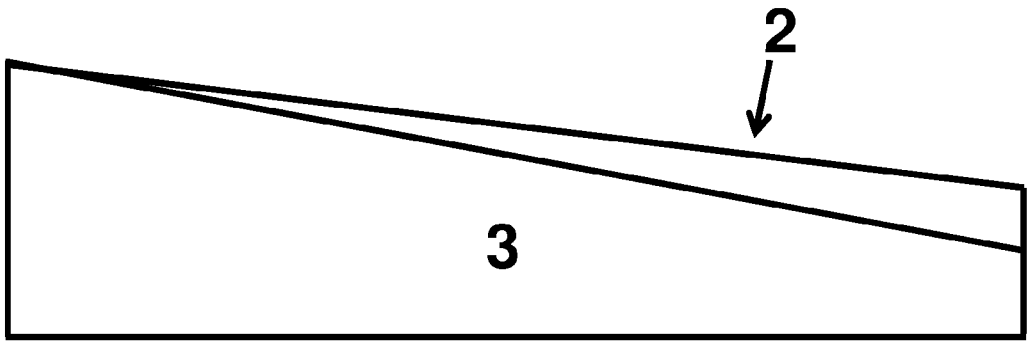
FIGS. 6A-6B illustrate side views of various additional embodiments of the polishing pad, the slope starting at the side (FIG. 6A) or at the midline (FIG. 6B) of the polishing pad, and the cloth having varying thicknesses.
Figure 6B:
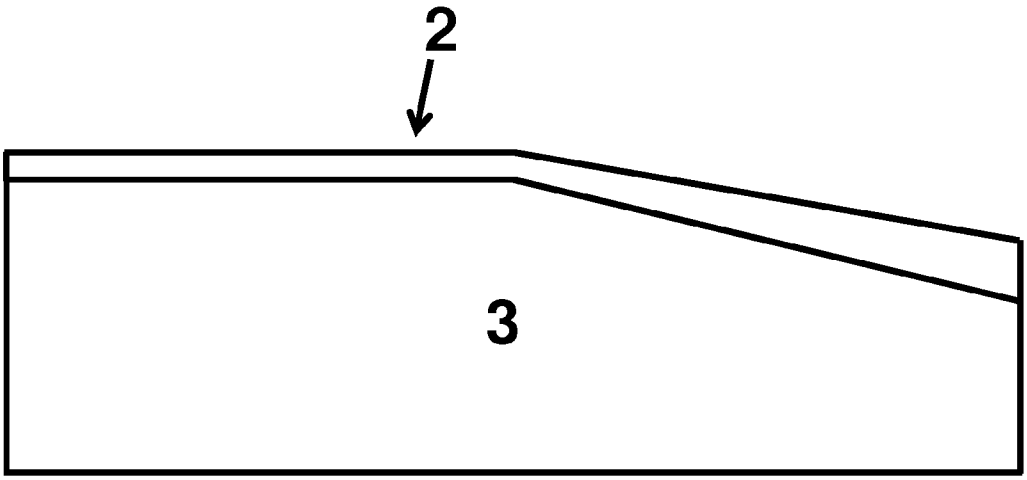

FIGS. 6A-6B illustrate side views of various additional embodiments of the polishing pad, the slope starting at the side (FIG. 6A) or at the midline (FIG. 6B) of the foam pad 3, and the cloth 2 having varying thicknesses. FIG. 6A shows a slope starting at one side of the foam pad 3 and ending at the other side of the foam pad 3, the cloth 2 having a continuously varying thickness from one side of the top surface of the foam pad 3 to the other, directly opposing side. FIG. 6B shows a slope starting at midline of the foam pad 3 and continuing an edge of the foam pad 3, the cloth 2 having a continuously varying thickness from the midline of the top surface of the cloth 2 to an edge of the cloth 2. In specific embodiments the cloth 3 thickness is maintained throughout the area of the other half of the top surface coverage of the foam pad 3.

Figure 7A:
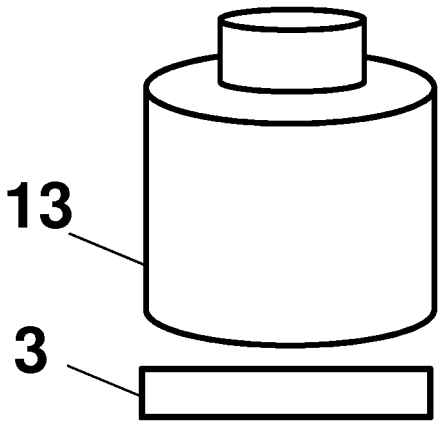
FIGS. 7A-7C illustrate a buffer head as described herein for use with a polishing pad.
Figure 7B:
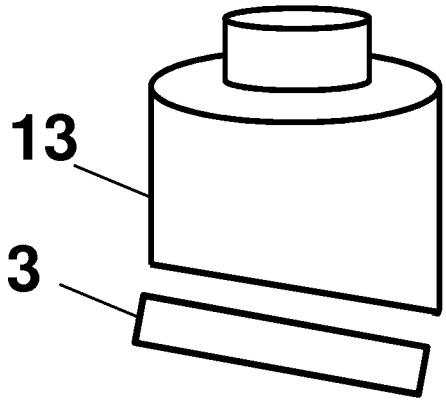
Figure 7C:
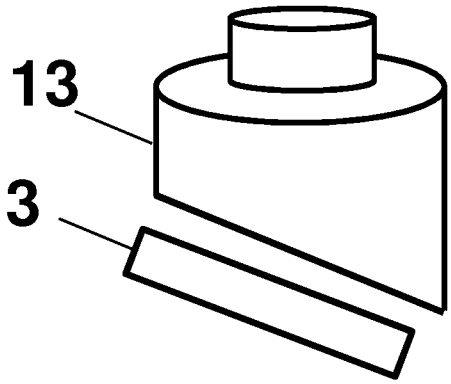

FIGS. 7A-7C illustrate a buffer head 13 as described herein for use with a polishing pad 1. Illustrated in FIG. 7A is a buffer head 13 set for coupling to a foam pad 3 of a polishing pad 1. In FIG. 7A the sides of the buffer head 13 are of equal length such that the bottom surface of the buffer head 13 provides a surface at a continuous level, and there is no sloping of the bottom surface from one side to the other. In FIG. 7B the bottom surface of the buffer head 13 is sloped, and the buffer head 13 is coupled to a polishing pad having a substantially equal thickness throughout. The result of the buffer head 13 being sloped, is that in FIG. 7B the length of a side of the buffer head 13 plus the height of the foam pad 3 on one side is different than the length of a side of the buffer head 13 plus the height of the foam pad 3 on the other side. FIG. 7C shows the buffer head 13 with a greater slope than that shown in FIG. 7B. In specific embodiments when the buffer head 13 and/or the foam pad 3 have a sloped surface, the difference in the length of a side of the buffer head 13 plus the height of the foam pad 3 on one side is different than the length of a side of the buffer head 13 plus the height of the foam pad 3 on the other side by at least one of: from about zero to about 5 inches, or from about 0.1 inch to about 4 inches, or about 0.1 to about 3 inches, or from about 0.1 to about 2 inches, or from about 0.1 to about 1 inch, or from about 0.1 to about 0.5 inches, or from about 0.5 to about 1 inches, or from about 0.5 to about 2 inches, or about 0.5 to about 3 inches, or from about 0.5 to about 4 inches, or from about 0.5 to about 5 inches.

In specific embodiments the polishing pad 1 further comprises the foam pad 3 coupled to a buffer head 13.

In specific embodiments the buffer head 13 has a sloped bottom surface.

Figure 8A:
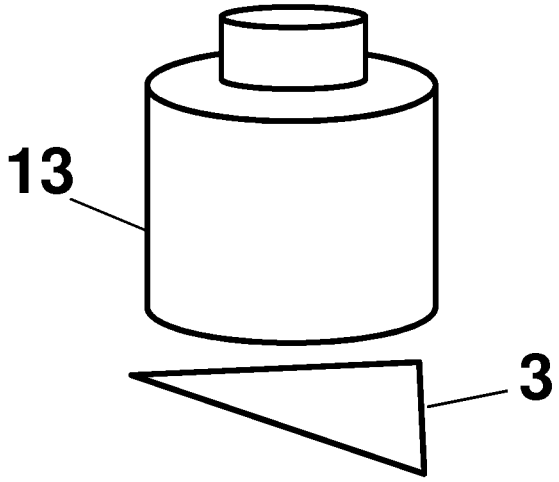
FIGS. 8A-8C illustrate a buffer head as described herein for use with a sloped polishing pad.
Figure 8B:
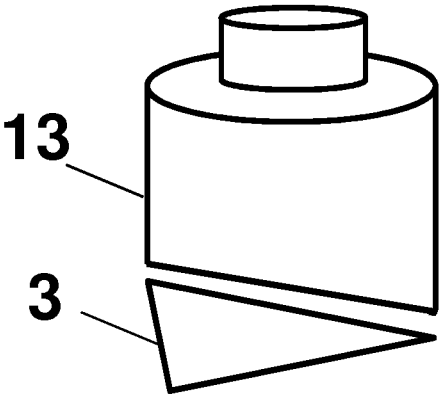
Figure 8C:
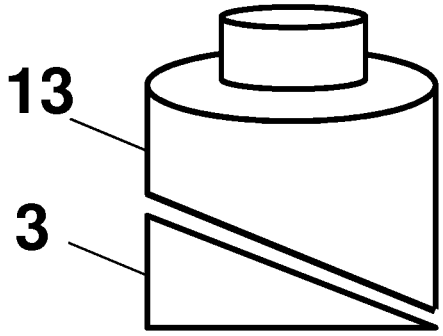

FIGS. 8A-8C illustrate the buffer head 13 of FIGS. 7A-7C, respectively, as described herein for use with a sloped polishing pad 1. FIG. 8A illustrates an embodiment wherein the sides of the buffer head 13 are of equal length such that the bottom surface of the buffer head 13 provides a surface at a continuous level, and there is no sloping of the bottom surface from one side to the other. In FIG. 8A the buffer head 13 is coupled to a foam pad 3 with a slope from one edge to another. The result of the foam pad 3 being sloped, is that in FIG. 8A the length of a side of the buffer head 13 plus the height of the foam pad 3 on one side is different than the length of a side of the buffer head 13 plus the height of the foam pad 3 on the other edge. FIGS. 8B and 8C illustrate when a sloped buffer head 13 is set to couple with a sloped foam pad 3 of a polishing pad 1. In FIG. 8B the result of the buffer head 13 being sloped and the foam pad 3 being sloped is that in FIG. 8B the length of a side of the buffer head 13 plus the height of the foam pad 3 on one side is different than the length of a side of the buffer head 13 plus the height of the foam pad 3 on the other side. In FIG. 8C the result of the buffer head 13 being sloped and the foam pad 3 being sloped is that in FIG. 8C the length of a side of the buffer head 13 plus the height of the foam pad 3 on one side is the same as the length of a side of the buffer head 13 plus the height of the foam pad 3 on the other edge.

Figure 9:
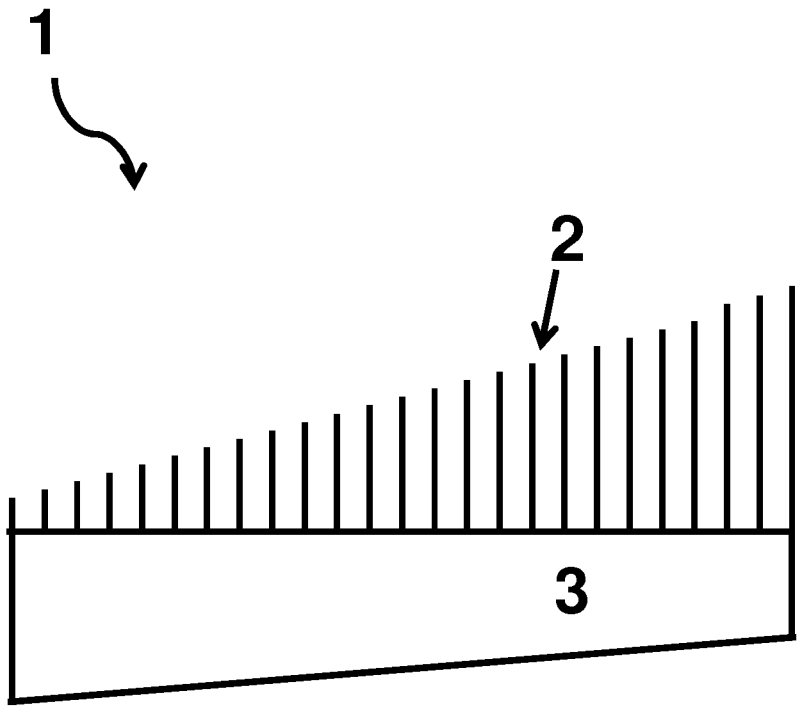
FIG. 9 illustrates a polishing pad with a sloped foam pad for use with a sloped cloth.

FIG. 9 illustrates a polishing pad 1 with a sloped foam pad 3 for use with a sloped cloth 2. In specific embodiments, the result of the sloped cloth and cloth pad is that the length of a side of the cloth 2 plus the height of the foam pad 3 on one side of is different than the length of a side of the cloth 2 plus the height of the foam pad 3 on the other side.

In specific embodiments the cloth 2 has a first thickness and a second thickness. In specific embodiments the cloth 2 and/or the foam pad 3 can have one, or can have more than one thickness, with non-limiting examples including 1, 2, 3, 4, 5, 6, 7, 8, 9 and/or 10 or more thicknesses each.

Figure 10A:
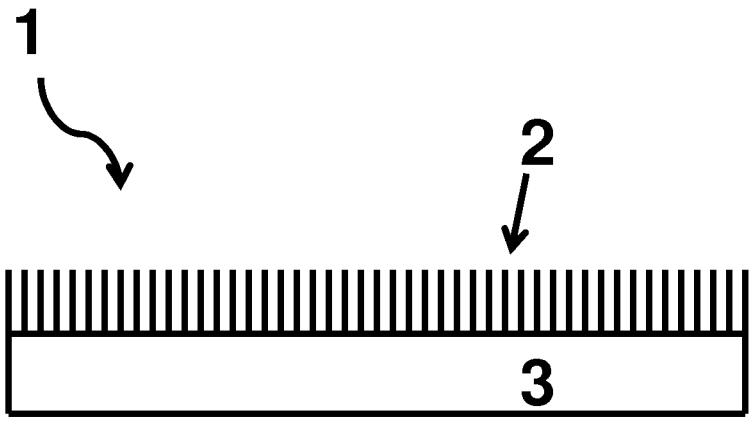
FIGS. 10A-10C illustrate various embodiments of a polishing pad with a foam pad and various cloth embodiments as provided herein.
Figure 10B:
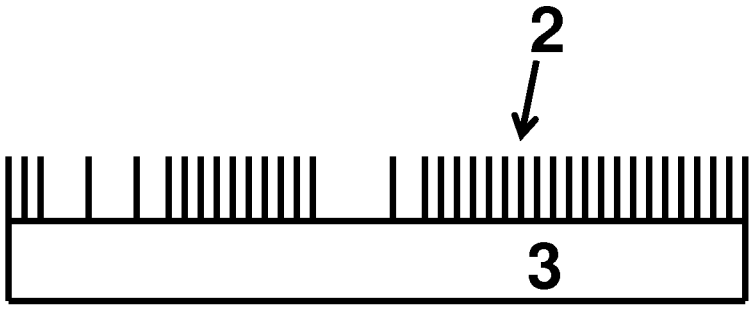
Figure 10C:
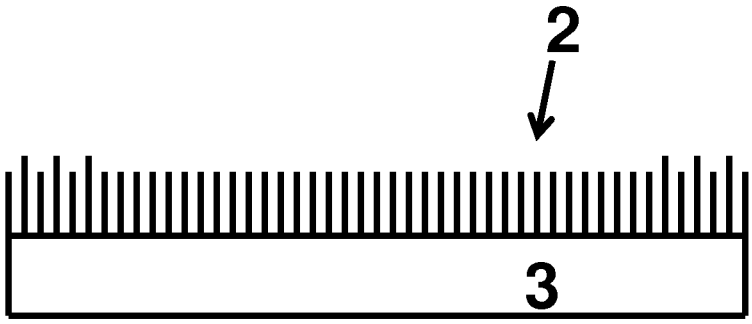

FIGS. 10A-10C illustrate various embodiments of a polishing pad 1 with a foam pad 3 and various cloth 2 embodiments as provided herein. In specific embodiments the fibers of the cloth 2 are equally spaced across the top surface of the foam pad 3 (FIG. 10A), and in others they are spaced irregularly (FIG. 10B), the fibers are of unequal length (FIG. 10C), or both.

Figure 11A:
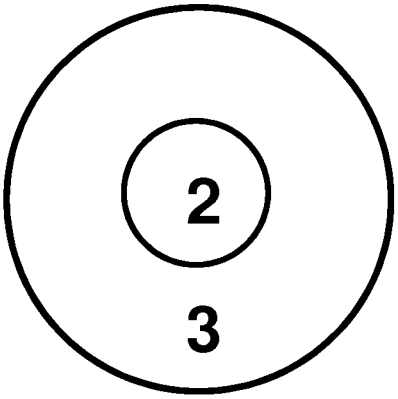
FIGS. 11A-11F illustrate various embodiments of a polishing pad as described herein, demonstrating various cloth arrangements.
Figure 11B:
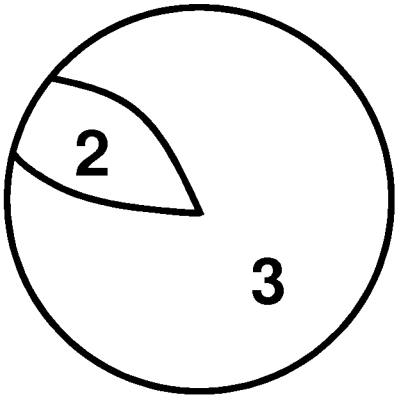
Figure 11C:
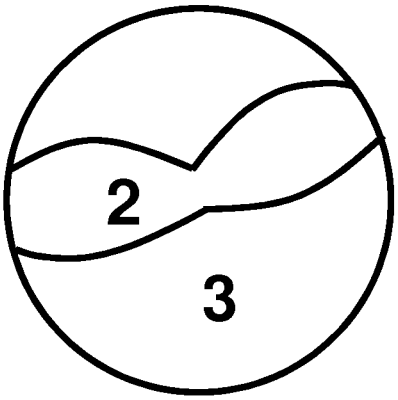
Figure 11D:
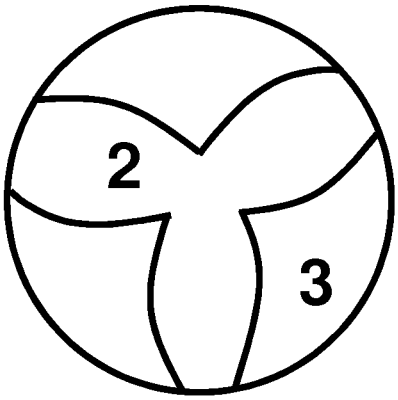
Figure 11E:
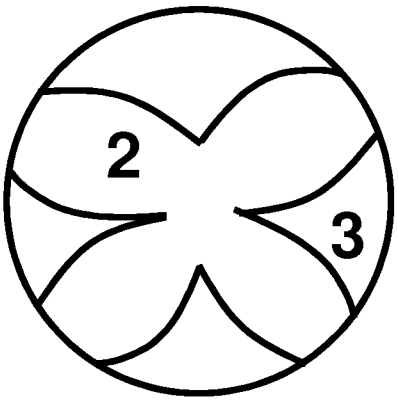
Figure 11F:
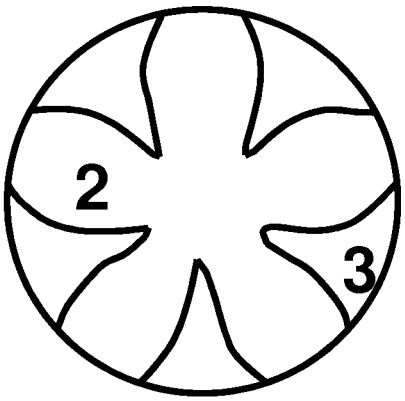

FIGS. 11A-11F illustrate various embodiments of a polishing pad 1 as described herein, demonstrating various cloth arrangements. FIG. 11A shows a top view of a polishing pad 1 showing the foam 3 with a cloth 2 covering that is central. FIG. 11B illustrates another top view of the polishing pad 1 showing the foam 3 with a cloth 2 covering extending out from about the center of the top of the polishing pad 1 to the periphery of the polishing pad 1. In specific embodiments the cloth 2 has a smallest width at about the center of the pad 1 as viewed from the top, then extends toward the periphery of the pad 1, having a greater cloth 2 middle width than edge width or central width. FIG. 11C, illustrates a cloth covering as in FIG. 11B, but with a second main area of coverage, and two gap areas (the areas not covered by cloth). FIG. 11D illustrates a cloth covering as in FIG. 11B, but with a third main area of coverage, and three gap areas. FIG. 11E illustrates a cloth covering as in FIG. 11B, but with a fourth main area of coverage, and four gap areas. FIG. 11F illustrates a cloth covering as in FIG. 11B, but with a fifth main area of coverage, and five gap areas.

In specific embodiments the polishing pad 1 has a central cloth covering area and a section extending out from the central cloth covering area which is bounded on each side by one of the gaps, the section extending out from the central cloth covering area toward the polishing pad perimeter such that the portion of the extending section near the center has a width that increases in the direction from the center to the periphery of the polishing pad, reaches a peak at about the middle of the extending section, and then decreases in width at the periphery of the polishing pad.

Figure 12:
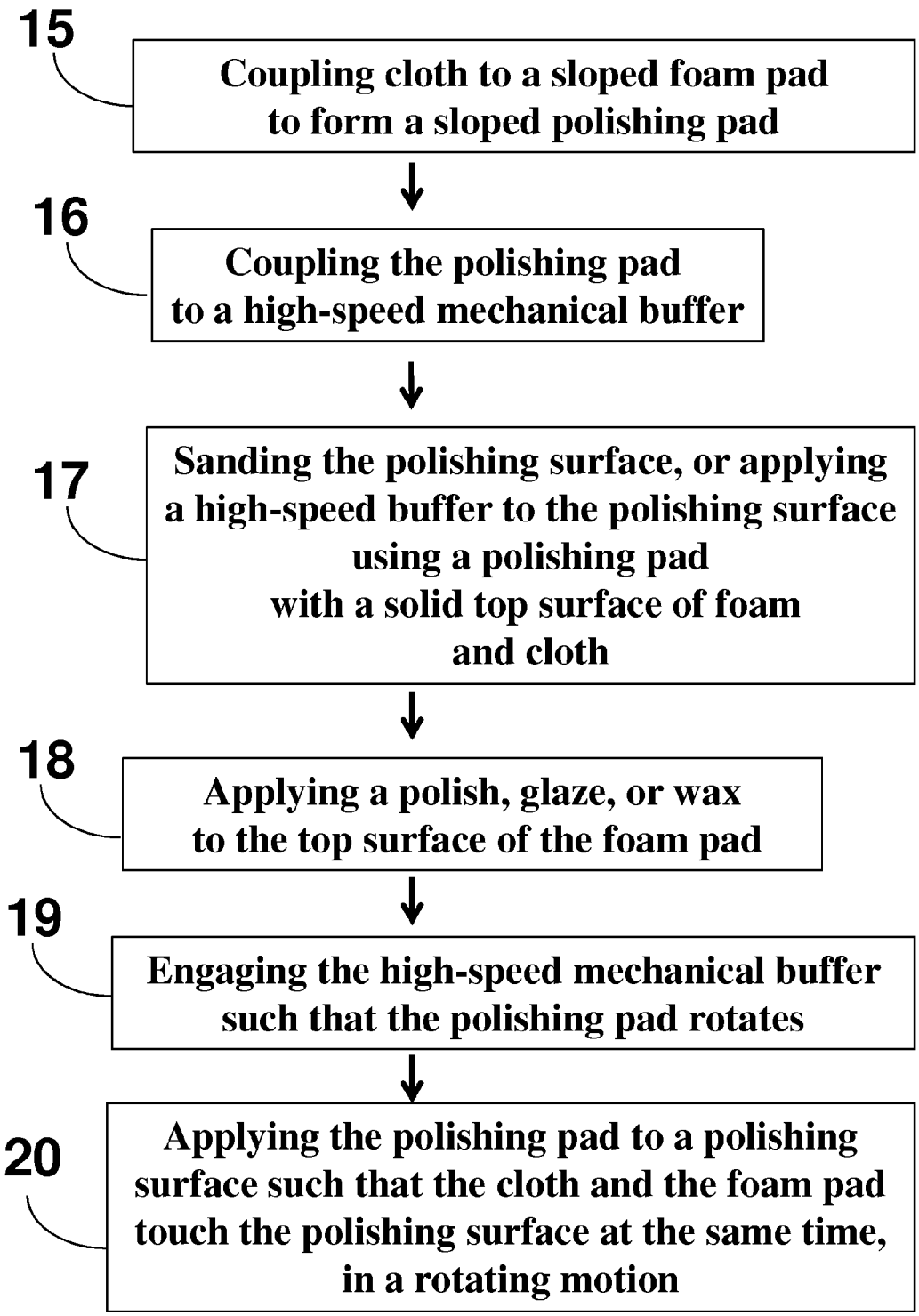
FIG. 12 illustrates an example method of polishing a surface as described herein such as a paint surface to remove a scratch or other irregularity using a polishing pad with a top surface of foam and cloth.

FIG. 12 illustrates an example method of polishing a surface as described herein such as a paint surface to remove a scratch or other irregularity using a polishing with a top surface of foam and cloth with surprising results. The provided flowchart indicates an embodiment for a method comprising one or more of: coupling 15 the cloth to a sloped foam pad to form a sloped polishing pad, coupling 16 the polishing pad to a high-speed mechanical buffer 8, sanding 17 the polishing surface, or applying a high-speed buffer 8 to the polishing surface using a polishing pad 1 with a solid top surface of foam and cloth, applying 18 a polish, glaze, or wax to the top surface of the foam pad, engaging 19 the high-speed mechanical buffer 8 such that the polishing pad 1 rotates, and/or applying 20 the polishing pad 1 to a polishing surface such that the cloth 2 and the foam pad 3 touch the polishing surface at the same time, in a rotating motion.

Figure 13A:
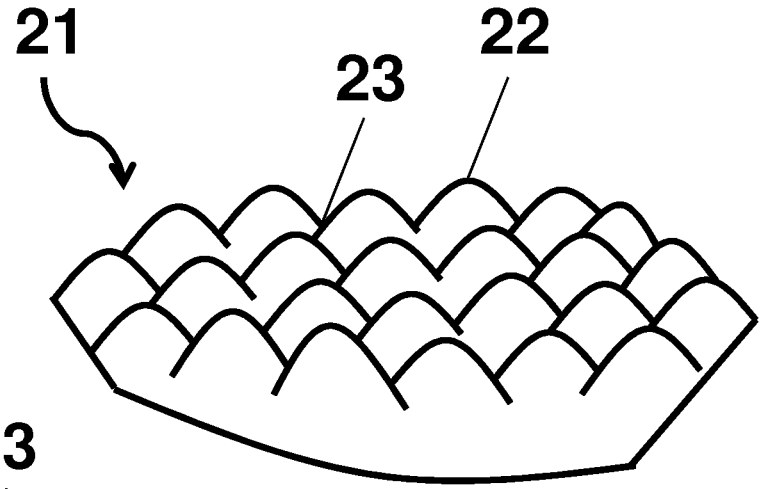
FIGS. 13A-13C illustrate an embodiment of a foam pad in a waffle-pad configuration as described herein.
Figure 13B:
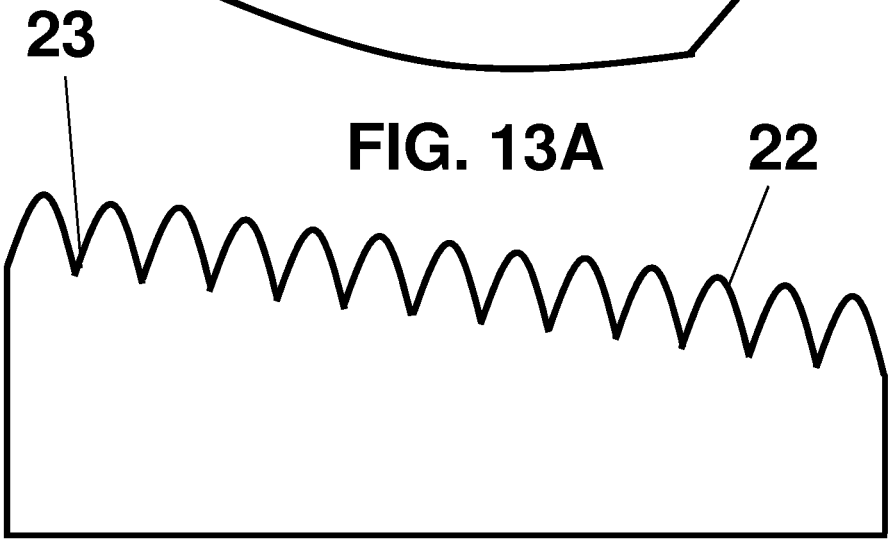
Figure 13C:
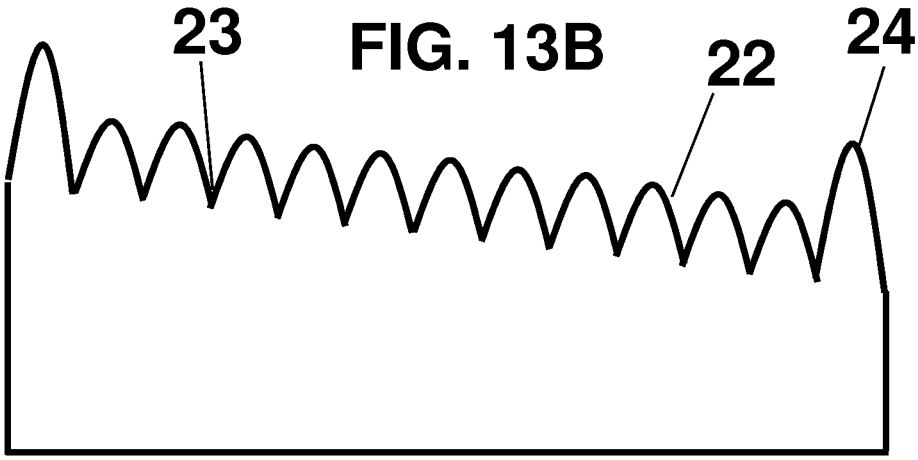

FIGS. 13A-13C illustrate an embodiment of a foam pad 3 in a waffle-pad 21 configuration as described herein. Illustrated in FIG. 13A, which shows a side and top view of the waffle-pad 21, are high points 22 and low points 23 of the waffle-pad 21. FIG. 13B shows a side view of the waffle-pad 21 showing the high points 22 and low points 23. In FIG. 13B the pattern is shown as a series of high points 22 of equal levels, width, and spacing. FIG. 13C shows a side view of the waffle-pad 21, and there are high points 22 and low points 23 as in FIG. 13B. However illustrated in FIG. 13C is that the waffle-pad 21 can a series of high points 22 at one level, and a series of high points 24 at a second level. In specific embodiments there are one or more high points of different levels (such as high point 22 versus high point 24). In specific embodiments there are 1, 2, 3, 4, 5, 6, 7, 8, 9, 10 or more different levels. In specific embodiments there are from 0-5, 0-10, 0-20 different levels. In specific embodiments the low points 23 are of equal depth throughout the waffle-pad 21, and in others there are 1, 2, 3, 4, 5, 6, 7, 8, 9, 10 or more different depths. In specific embodiments there are from 0-5, 0-10, 0-20 different depths.

In specific embodiments described herein the sloped polishing pad comprises a foam pad 3 comprising a continuous slope such that the first thickness at one side of the foam pad 3 comprises the thickest part of the foam pad 3, and the directly opposing second side comprises the second thickness comprising the thinnest part of the foam pad 3.

In specific embodiments described herein the methods comprise applying a polish to the top surface of the first polishing pad and applying the first polishing pad to the polishing surface such that the cloth 2 and the foam pad 3 touch the polishing surface at the same time.

In specific embodiments described herein the methods comprise coupling the first polishing pad to a high-speed mechanical buffer 8 and engaging the high-speed mechanical buffer 8 such that the first polishing pad rotates at from about 1000 to about 3000 rotations per minute.

In specific embodiments described herein the methods comprise uncoupling the first polishing pad from the high-speed mechanical buffer 8, coupling to the high-speed mechanical buffer 8 a second polishing pad comprising a second foam pad comprising a third thickness and fourth thickness, and engaging the high-speed mechanical buffer 8 such that the second polishing pad rotates at from about 1000 to about 3000 rotations per minute. In specific embodiments the second foam pad can have 1, 2, 3, 4, 5, 6, 7, 8, 9, or 10 or more thicknesses, that are the same or different from thicknesses of the first pad described herein.

In specific embodiments described herein the methods comprise coupling a polishing pad 1 as described herein with a buffer head 13 with a sloping bottom surface and/or polishing the polishing surface with the polishing pad such that cloth 2 and the foam pad 3 touch the polishing surface at the same time, the polishing surface being in specific examples a surface of paint from at least one of a car, a boat, or an airplane.

In specific embodiments described herein the methods comprise the foam pad 3 comprising a first thickness and a second thickness.

In specific embodiments the top surface of the polishing pad 1 can be covered with foam, with cloth 2, and with a third material and/or fourth material as described herein or known in the art. The third and/or fourth material can cover about zero to about five percent, or about five to about ten percent, or from about one to about ten percent, or about one to about twenty percent, or about ten to about twenty percent of the top surface area of the polishing pad 1.

In specific embodiments the fibers of the cloth 2 can all be equally spaced, all be unequally spaced, or a combination thereof. In specific embodiments the lengths of fibers for a cloth 2 or part of a cloth can all be equal in length, all be unequal in length, or a combination thereof. In specific embodiments the lengths are in part equal and in part unequal in length, and in part equally spaced and in part unequally spaced. In specific embodiments of the polishing pad 1 as described herein, the length of the fibers of the cloth 2 can be configured such that an initial polishing is performed with only the cloth 2 touching the polishing surface, and upon additional force being provided toward the polishing surface by the high-speed mechanical buffer 8, the cloth 2 fibers bend, and the foam pad 3 then touches the polishing surface, and the polishing in the second step involves touching of the foam pad 3 and the cloth 2 at the same time to the polishing surface. In specific embodiments the cloth 2 can be recessed into the foam pad 3 and/or into openings in the top surface of the foam pad 3 such that the only the foam pad 3 first touches a polishing surface, and upon additional force being provided by a high-speed mechanical buffer 8 when polishing a polishing surface, the cloth 2 fibers and the foam pad 3 touch the polishing surface at the same time. In specific embodiments of the foam pad at rest, the top of a fiber of the cloth 2 may rest about 0.1 to about 0.5 inch below the foam pad surface in at least one recess in the top surface of the foam pad 3. In specific embodiments there are about 1 to about 5 recesses or from about 1 to about 10 recesses.

In specific embodiments described herein the methods comprise the foam pad 3 comprising a continuous slope such that the first thickness at one side of the foam pad 3 comprises the thickest part of the foam pad 3, and the directly opposing second side comprises the second thickness comprising the thinnest part of the foam pad 3.

Specific embodiments comprise a central cloth covering that in specific embodiments is approximately circular, with from 1 to 5 areas of cloth coverage extending out to the periphery.

In specific embodiments the top surface (the surface facing outward from the foam pad 3 and toward a surface to polish) of the foam pad 3 and all fibers of the cloth 2 are at the same level. For example the top surface of the foam pad 3 can be cut so as to have an impression of the cloth 2, which sits exactly into the impression. In other embodiments the top surface of the cloth 2 extends in part or in full above from the foam pad (such as one of more fibers).

In specific embodiments methods or devices as provided herein provide for use on a surface such as a paint surface, such as for a car, showing imperfections such as scratches. In specific embodiments the paint has a clear coat, a basement coat, and a primer, and various imperfections such as scratches in the clear coat can be removed via polishing as described herein. An aim of current embodiments provided herein is to remove such imperfections. In specific embodiment, upon polishing the clear coat is thinner, as some of the clear coat is removed to smooth the surface. In specific embodiments a minimal amount of the clear coat is removed. In specific embodiments no clear coat is removed, with the polishing only reorganizes molecules of the coat to smooth. In specific embodiments the outer surface is a paint base surface, and in specific embodiments described herein, no paint is removed; only the molecules of the paint are reorganized to smooth.

In specific embodiments sand paper or other sanding tool used herein can be from about 1200 to 2000 grit, or from about 1200-1500 grit, or from about 1500-2000 grit. In other embodiments, one or more ranges of sand paper or other sanding tool abrasiveness can be used such as: from about 1600-2000, 1700-2000, 1800-2000, 1900-2000, 1600-1700, 1600-1800. 1600-1900, 1200-1300, 1200-1400 grit.

In specific embodiments two polishing pads are used at once on a high-speed mechanical buffer providing rotation for polishing.

Embodiments provided herein can have a hook and loop backing or other backing so that the polishing pad can be coupled to a high-speed mechanical buffer 8.

Embodiments provided herein can be used with an intermediate piece 14, and the foam pad 3 can be solid foam or include an additional material, such as for stabilization. In additional embodiments the additional material is a second foam of a different hardness. The intermediate piece 14 can be a connector of the foam pad 3 to the buffer head 13. This intermediate piece 14 can be VELCRO to adhere together the foam pad 3 to the buffer head 13. The intermediate piece 14 can also be a plastic or metal piece that snaps, screws, or hooks together the foam pad 3 to the buffer head 13.

Embodiment provided herein can be used on paints such as car paints, as well as other surfaces, such as windows. Specific embodiments provided herein can be used to provide a smooth surface following a scratch to a headlight, window, or other plastic surfaces.

Embodiments of polishing pads 1 described herein can be used for one or more of: polishing, glazing, waxing, and/or with polishes, glazes, and/or waxes.

In specific embodiments the polishing is performed for from about one to about ten minutes or more; in some embodiments the time of engagement of the high-speed mechanical buffer 8 can be in one or more ranges from about: 0-20 minutes, 0-10 minutes, 0-5 minutes, or 5-10 minutes. In specific embodiments a second polishing pad with a foam and cloth top surface is used for polishing for a time of at least one of the ranges provided.

In specific embodiments the foam pad 3 has a substantially flat top surface. In specific embodiments the foam pad 3 is substantially round as viewed from the top surface, though in specific embodiments it can be elliptical or square, or of another shape known in the art, such as those useable with a high-speed mechanical buffer 8.

In specific embodiments the top surface of the polishing pad 1 and/or the cloth 2 has segments that are in irregular shapes, regular shapes (meaning homogenous), and in shapes of, for example, hexagonal shape, round, square, diamond, and/or ellipsoid shape, and/or a combination thereof. In specific embodiments the top surface of the foam pad 3 and or cloth 2 has these shapes and is thus not perfectly smooth. In specific embodiments at least one of the shapes on the top surface of the foam pad 3 has a cloth covering, and in other embodiments from about one to about half of the shapes of the foam pad 3 are covered with cloth 2 and in specific embodiments from about one to about half of the shapes of a top surface of the foam pad 3 are not covered with cloth 2. In specific embodiments a percentage of one or more shapes of the foam pad 3 is covered, such as from about 1 to about 100 percent of at least one shape being covered by cloth.

The cloth 2 and foam pad 3 can be coupled via one or more of: glue, stitching, hooking, and/or clamping, or adhered in ways known in the art.

Embodiments provided herein can include a hand-held version, referring to embodiments within the thinner ranges of foam thicknesses as herein described, having a top surface of foam and/or cloth and/or a foam different from the foam of the foam pad as herein described. A hand-held version can be used in specific methods in addition to use with a high-speed buffer. For example, in specific non-limiting embodiments a hand-held polishing pad 1 is about 4 inches in diameter, about 1.5 inches at the thickest point, and about 1 inch at the thinnest point, sloping in about a straight line from one edge to another. Such angled configuration provides a match with a hand-shape and allows a heel of the palm of the hand to set against the lower part of the foam pad such that there is less strain on the hand ligaments and muscles, putting the hand in a more natural position for polishing. In specific embodiments the polishing pad 1 is used in a method of polishing and/or sealing by methods using hand application of polisher and/or sealant. In specific embodiments a circular motion of the polishing pad 1 by hand is used. In specific embodiments the polishing pad 1 and/or the foam pad 3 is from about 0.1 to about 1, 2, 3, 4, or 5 inches thick on one side, and about 0.1 to about 1, 2, 3, 4, 5, 6, 7, 8, 9, or 10 inches on the other. The difference from the thickest point of the pad to the thinnest point of the pad can be from about 0.1 to about 0.5, 1, 1.5, 2, 2.5, 3, or 3.5 inches, and the thickest point and thinnest point can be at points of the pad directly opposite each other, or the thickest and thinnest points can be located at any place on the foam pad 3. In specific embodiments the foam pad 3 to be used by hand is covered with cloth 2, foam, a foam composite, or a combination thereof. In specific embodiments the foam pad 3 is a composite foam, with 2, 3, 4, 5, 6, 7, 8, 9, or 10 or more types of foams used together, one or more of which has a different abrasiveness and/or hardness from one or more of the other foam types used. In specific embodiments the foam pad 3 and/or the foam covering the top surface of the pad are comprised of types of foam of 1, 2, 3, 4, 5, 6, 7, 8, 9, or 10 different abrasivenesses. In specific embodiments the foam pad 3 has a top surface of 0, 1, 2, 3, 4, 5, 6, 7, 8, 9, or 10 or more types of foam (and/or another foam or foam composite coupled to the top of the foam pad 3 comprised of 0, 1, 2, 3, 4, 5, 6, 7, 8, 9, or 10 or more types of foam), with or without cloth 2 types (1, 2, 3, 4, 5, 6, 7, 8, 9, or 10 or more different types) in any configuration known. In specific embodiments the foam pad 3 has only a single foam type at the top and without cloth, the single foam covering in specific embodiments about 90-100 percent of the top area of the foam pad 3. In specific embodiments the cloth completely covers the foam pad without gaps. In specific embodiments there are two or more types of cloth 2 and/or two or more types of foam at the top surface of the foam pad 3, to be used by hand and/or with a high-speed buffer, that are configured such that the two or more types of cloth 2 and/or two or more types of foam touch a polishing surface at the same time upon polishing the surface. In specific embodiments a foam pad 3 has a bonnet made of any material or materials herein described, and can be placed over the surface of a foam pad 3, with or without gaps and with or without two or more cloth types and/or two or more foam types. In specific embodiments the foam pad 3 is angled and has no cloth 2 and no second foam type.

In specific embodiments the polishing pad 1 can be formed into a bonnet made of cloth 2 and foam. In specific embodiments the foam pad 3 has a backing and/or has a core material for stabilizing and providing more support for the foam pad 3.

Specific embodiments of the polishing pad 1 as provided herein are from about 2-12 inches in diameter, and/or 4-10 inches, and/or from 4.5-8 inches, and/or from about 4.5-6.5 inches, and/or about: 4.5 inches, 5 inches, 6.5 inches, 8 inches, and/or 10 inches.

In specific embodiments the polishing pad 1 is about 10.75 inches in diameter and about one and three-quarters inches thick. In specific embodiments the polishing pad 1 and/or the foam pad 3 can be in the following ranges: from about 0.1 inch to about 3 inches thick, from about 0.1 inch to about 0.5 inch, about 1 inch to about 3 inches, about 1 inch to about 2 inches, and/or about 2 inches to about 3 inches.

Embodiments provided herein can be used with compounds such as one or more of heavy, medium, or light polishes such as: V32, V34, V36, V38, and/or V40.

In specific embodiments the foam pad 3 and the cloth 2 have different abrasivenesses. In specific embodiments a second polishing can be performed with a second polishing pad having a foam and cloth surface, wherein the first and second polishing pads have at least one part of the surface that is different in abrasiveness from the first pad.

The cloth 2 can be comprised of, for example, any microfiber, cotton, microfiber, polyester, polyamide, and polypropylene, wool, hair, silk, flax, or other fiber. In a non-limiting example the cloth 2 is comprised of polyester and polyamide, such as 80 percent polyester and 20 percent polyamide. In other embodiments at least part of or the full area of the cloth 2 has from about 50 to about 100 percent polyester, and/or about 50 to about 60 percent, about 50 to about 70 percent, about 50 to about 80 percent, and/or about 50 to about 90 percent polyester; other polyester percentages in non-limiting embodiments for at least part of the cloth 2 include at least about: 50-60, 60-70, 70-80, 80-90, 90-100 percent. In other embodiments at least part of or the full area of the cloth 2 has from about 50 to about 100 percent polyamide, and/or about 50 to about 60 percent, about 50 to about 70 percent, about 50 to about 80 percent, and/or about 50 to about 90 percent polyamide; other polyamide percentages in non-limiting embodiments for at least part of the cloth 2 include at least about: 50-60, 60-70, 70-80, 80-90, 90-100 percent. In specific embodiments the cloth 2 is in the form of a weave.

In specific embodiments the cloth 2 has a linear mass density of from about 0.7 to about 1.3 denier, and in other embodiments, from about 0.5 to about 1.5 denier, and/or from about 0.7 to about 1 denier, and/or from about 1 to about 1.5 denier, and/or from about 1.1 to about 1.25 denier, and/or from about 1.25 to about 1.3 denier, and/or from about 1.25 to about 1.5 denier.

In specific embodiments cutting, polishing, and glazing are performed with one of the embodiments of the polishing pad 1 described herein.

In specific embodiments the cloth 2 is only present on the top surface of the foam pad 3, and in specific embodiments the cloth 2 is only coupled to the top surface of the foam pad 3.

In specific embodiments of methods of use for the polishing pad 1 comprise one or more of: coupling cloth 2 to a foam pad 3 to form a polishing pad 1, coupling the polishing pad 1 to a high-speed mechanical buffer 8, applying a polish, glaze, or wax to the top surface of the foam pad 3, engaging the high-speed mechanical buffer 8 such that the polishing pad 1 rotates, and/or applying the polishing pad 1 to a polishing surface such that the cloth 2 and the foam pad 3 touch the polishing surface at the same time, in a rotating motion.

The invention claimed is:

1. A sloped polishing pad for use with high-speed mechanical buffers or for use by hand comprising:

a foam pad comprising a top surface, the foam pad comprising a continuous slope such that a first thickness at one side of the foam pad comprises a thickest part of the foam pad, and a directly opposing second side comprises a second thickness comprising a thinnest part of the foam pad; and at least one of a cloth and a foam that are each different in abrasiveness than the foam pad coupled to the top surface of the foam pad, the at least one of the cloth and the foam covering part of the top surface of the foam pad such that gaps in the coverage provided by the at least one of the cloth and the foam allow for the foam pad and the at least one of the cloth and the foam to touch a polishing surface at the same time.

2. The sloped polishing pad of claim 1 wherein the first thickness of the foam pad comprises from about 2 inches to about 3 inches, and the second thickness comprises from about 0.5 inches to about 1.5 inches.

3. The sloped polishing pad of claim 1 comprising the cloth and the foam coupled to the top surface of the foam pad, the sloped polishing pad configured such that the foam pad, the cloth, and the foam touch the polishing surface at the same time.

4. The sloped polishing pad of claim 1 wherein a difference between the first thickness and the second thickness of the foam pad is from about 0.1 inches to about 2 inches, and the foam pad has a waffle-pad configuration.

5. The sloped polishing pad of claim 1 wherein the foam pad has a top surface that is substantially circular, and the foam pad top surface has a diameter of from about 2 to about 12 inches, and wherein the foam pad comprises a composite comprising at least two foams of different abrasivenesses from each other and from the abrasivenesses of the at least one of the cloth and the foam covering part of the top surface of the foam pad.

6. The sloped polishing pad of claim 1 wherein the first thickness is from about 2 to about 3 inches, and the second thickness is from about 0.1 to about 1.5 inches.

7. The sloped polishing pad of claim 1 further comprising the sloped polishing pad coupled to a buffer head.

8. The sloped polishing pad of claim 7 wherein the buffer head has a sloped bottom surface.

9. The sloped polishing pad of claim 1 wherein the cloth has a first thickness and the cloth has a second thickness.

10. A method of removing imperfections from a polishing surface comprising:

providing a first polishing pad comprising:

a foam pad comprising a top surface, the foam pad comprising a continuous slope such that a first thickness at one side of the foam pad comprises a thickest part of the foam pad, and the directly opposing second side comprises a second thickness comprising a thinnest part of the foam pad; and a cloth coupled to the top surface of the foam pad, the cloth covering part of the top surface of the foam pad such that gaps in coverage provided by the cloth allow for the cloth and the foam pad to touch the polishing surface at the same time;

performing at a point of an imperfection at least one of: sanding the polishing surface, or applying a high-speed mechanical buffer to the polishing surface with a polishing pad with a solid top surface of the foam ad and the cloth; and polishing the polishing surface with the first polishing pad such that cloth and the foam pad touch the first polishing surface at the same time, the polishing surface being a surface of paint from at least one of a car, a boat, or an airplane.

11. The method of claim 10 further comprising applying a polish to the top surface of the first polishing pad and applying the first polishing pad to the polishing surface such that the cloth and the foam pad touch the polishing surface at the same time.

12. The method of claim 10 further comprising uncoupling the first polishing pad from the high-speed mechanical buffer, coupling to the high-speed mechanical buffer a second polishing pad comprising a second foam pad comprising a third thickness and a fourth thickness, and engaging the high-speed mechanical buffer such that the second polishing pad rotates at from about 1000 to about 3000 rotations per minute.

13. A method of removing imperfections from a polishing surface comprising:

providing a buffer head with a sloping bottom surface and coupling the buffer head to a polishing pad, the polishing pad comprising:

a foam pad comprising a continuous slope such that a first thickness at one side of the foam pad comprises a thickest part of the foam pad, and the directly opposing second side comprises a second thickness comprising a thinnest part of the foam pad; and a cloth coupled to a top surface of the foam pad, the cloth covering part of the top surface of the foam pad such that gaps in the coverage provided by the cloth allow for the cloth and the foam pad to touch the polishing surface at the same time;

performing at a point of an imperfection at least one of: sanding the polishing surface, or applying a high-speed mechanical buffer to the polishing surface with the polishing pad with a solid top surface of the foam pad and the cloth; and polishing the polishing surface with the polishing pad such that the cloth and the foam pad touch the polishing surface at the same time, the polishing surface being a surface of paint from at least one of a car, a boat, or an airplane.

14. The method of claim 13 further comprising applying a polish to the top surface of the polishing pad prior to applying the polishing pad to the polishing surface.

15. A method of removing imperfections from a polishing surface comprising:

providing a first polishing pad comprising:

a foam pad comprising a continuous slope such that a first thickness at one side of the foam pad comprises a thickest part of the foam pad, and the directly opposing second side comprises a second thickness comprising a thinnest part of the foam pad; and a cloth coupled to the top surface of the foam pad, the cloth covering part of the top surface of the foam pad such that gaps in coverage provided by the cloth allow for the cloth and the foam pad to touch the polishing surface at the same time;

applying, at a point of an imperfection, a high-speed mechanical buffer to the polishing surface with a polishing pad with a solid top surface of the foam pad and the cloth by coupling the first polishing pad to the high-speed mechanical buffer and engaging the high-speed mechanical buffer such that the first polishing pad rotates at from about 1000 to about 3000 rotations per minute; and polishing the polishing surface with the first polishing pad such that cloth and the foam pad touch the first polishing surface at the same time, the polishing surface being a surface of paint from at least one of a car, a boat, or an airplane.

* * * * *